US009462636B2

(12) United States Patent
Ranish et al.

(10) Patent No.: US 9,462,636 B2
(45) Date of Patent: Oct. 4, 2016

(54) RTP LAMP BASE WITH REMOVAL FEATURES

(71) Applicant: Applied Materials, Inc., Santa Clara, CA (US)

(72) Inventors: Joseph M. Ranish, San Jose, CA (US); Douglas R. McAllister, Pleasanton, CA (US)

(73) Assignee: APPLIED MATERIALS, INC., Santa Clara, CA (US)

( * ) Notice: Subject to any disclaimer, the term of this patent is extended or adjusted under 35 U.S.C. 154(b) by 0 days.

(21) Appl. No.: 14/252,430

(22) Filed: Apr. 14, 2014

(65) Prior Publication Data

US 2015/0189697 A1 Jul. 2, 2015

Related U.S. Application Data

(60) Provisional application No. 61/922,425, filed on Dec. 31, 2013.

(51) Int. Cl.
*H05B 3/00* (2006.01)

(52) U.S. Cl.
CPC ..... *H05B 3/0047* (2013.01)

(58) Field of Classification Search
CPC ..... F21V 17/04; F21V 21/00; F21V 21/08; F21V 21/0832; H05B 3/0038; H05B 3/0047
USPC ..... 313/15, 318.01, 318.03, 318.05, 313/318.07, 578
See application file for complete search history.

(56) References Cited

U.S. PATENT DOCUMENTS 3,859,554 A * 1/1975 Preziosi et al. ..... 313/315
4,322,658 A * 3/1982 Minarczyk ..... 315/47
4,924,368 A * 5/1990 Northrop et al. ..... 362/376
5,483,432 A 1/1996 Wang
5,847,512 A * 12/1998 Baba et al. ..... 315/51
7,612,491 B2 11/2009 Ranish et al.
2001/0014021 A1* 8/2001 Duff et al. ..... 362/268
2005/0286243 A1* 12/2005 Ranish et al. ..... 362/89
2006/0066193 A1* 3/2006 Ranish et al. ..... 313/116
2006/0119245 A1 6/2006 Arndt et al.
2007/0291477 A1 12/2007 Khubani
2008/0074057 A1* 3/2008 Pawelek et al. ..... 315/291
2012/0206041 A1 8/2012 Gerhard et al.

FOREIGN PATENT DOCUMENTS

EP 0 601 865 A1 6/1994

OTHER PUBLICATIONS

PCT Notification of Transmittal of the International Search Report and the Written Opinion of the International Searching Authority for International Application No. PCT/US2014/066890 dated Mar. 31, 2015; 14 total pages.

* cited by examiner

*Primary Examiner* — Donald Raleigh
*Assistant Examiner* — Kevin Quarterman
(74) *Attorney, Agent, or Firm* — Patterson & Sheridan, LLP

(57) ABSTRACT

A lamp device for thermal processing of a substrate is provided. The lamp device includes a bulb enclosing a filament, the filament having a pair of leads. The lamp device further includes a lamp base. The lamp base includes a seal connecting the bulb to the lamp base; a sleeve having one or more walls and two ends with one end surrounding the seal; a potting compound filling the sleeve; one or more wires distributed through the sleeve and the potting compound and coupled to the pair of leads; and one or more hookable features located within 10 mm of the sealing end.

20 Claims, 6 Drawing Sheets

RTP LAMP BASE WITH REMOVAL FEATURES

CROSS REFERENCE TO RELATED APPLICATIONS

This application claims benefit of U.S. provisional patent application Ser. No. 61/922,425, filed Dec. 31, 2013, which is herein incorporated by reference.

FIELD

Aspects of the embodiments described relate generally to lamp devices used for thermal processing of semiconductor substrates. More particularly, the embodiments described relate to lamp devices having features that simplify removal of a lamp device from thermal processing chambers when the lamp device fails.

BACKGROUND

Rapid thermal processing (RTP) is one thermal processing technique that allows rapid heating and cooling of a substrate, such as a silicon wafer. RTP wafer processing applications include annealing, dopant activation, rapid thermal oxidation, and silicidation among others. Typical peak processing temperatures can range from about 450° C. to 1100° C. The heating is typically done in a RTP chamber with lamp devices disposed above or below the substrate being processed.

FIG. 1 is a schematic front view of a traditional lamp 50 used in an RTP chamber (not shown). The bulb 70 is connected to a lamp base 60 through a seal 80. The lamp 50 also has typical features of lamps, such as filament (not shown) in the bulb 70 and wires (not shown) to connect the filament to electrical power. The lamp base 60 is coupled to a plug 90, which is coupled to electrical power (not shown) when the lamp 50 is in use.

A common problem with all lamps is eventual lamp failure. When a RTP chamber uses lamps to heat the substrate from below, access to remove the lamp is often limited the areas around the bulb. For example, when a lamp, such as lamp 50, fails in a RTP chamber, lamp 50 can be removed with a hose having a suction end to grip the bulb 70. A problem arises when the bulb 70 breaks or another issue prevents removal of lamp 50 by using a suction device. Often the chamber housing lamp 50 will have to be disassembled to remove a lamp 50 with a broken bulb 70. Disassembling a chamber to remove a lamp is time consuming and is not cost effective.

Therefore, a need exists for improved lamps that simplify removal of the lamps from thermal processing chambers.

SUMMARY

In one embodiment, a lamp device for thermal processing of a substrate is provided. The lamp device includes a bulb enclosing a filament, the filament having a pair of leads. The lamp device further includes a lamp base. The lamp base includes a seal connecting the bulb to the lamp base; a sleeve having one or more walls and two ends with one end surrounding the seal; a potting compound filling the sleeve; one or more wires distributed through the sleeve and the potting compound and coupled to the pair of leads; and one or more hookable features located within 10 mm of the sealing end.

In another embodiment, a lamp device for thermal processing of a substrate is provided. The lamp device includes a bulb enclosing a filament, the filament having a pair of leads. The lamp device further includes a lamp base. The lamp base includes a seal connecting the bulb to the lamp base; a sleeve extending around a longitudinal axis and having a first end and a second end, the first end being opposite of the second end, wherein the first end surrounds the seal; a potting compound filling the sleeve; and one or more hookable features located within 10 mm of the first end.

In another embodiment, a lamp device for thermal processing of a substrate is provided. The lamp device includes a bulb enclosing a filament, the filament having a pair of leads. The lamp device further includes a lamp base. The lamp base includes a seal connecting the bulb to the lamp base; a sleeve extending around a longitudinal axis and having a first end and a second end, the first end being opposite of the second end, wherein the first end surrounds the seal; a potting compound filling the sleeve; and one or more tabs having one or more holes, the one or more holes located within 10 mm of the first end, wherein the one or more tabs extend from the first end and are angled towards the longitudinal axis.

BRIEF DESCRIPTION OF THE DRAWINGS

So that the manner in which the recited features of the embodiments described above can be understood in detail, a more particular description, briefly summarized above, may be had by reference to the following embodiments, some of which are illustrated in the appended drawings. It is to be noted, however, that the appended drawings illustrate only typical embodiments and are therefore not to be considered limiting of its scope to exclude other equally effective embodiments.

To facilitate understanding, identical reference numerals have been used, where possible, to designate identical elements that are common to the figures. It is contemplated that elements disclosed in one embodiment may be beneficially utilized on other embodiments without specific recitation.

DETAILED DESCRIPTION

An improved lamp is described that provides advantages in removing such lamps from the thermal processing chambers that house the lamps.

Figure 1:
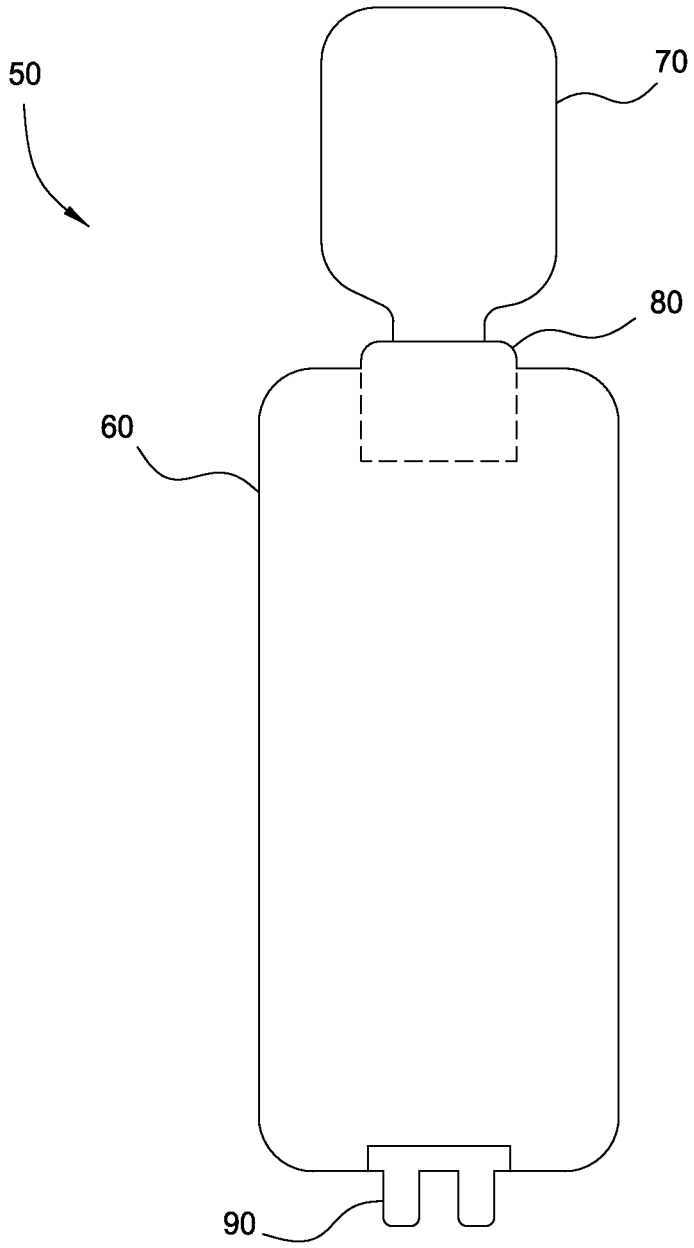
FIG. 1 (PRIOR ART)
FIG. 1 is a schematic front view of a traditional lamp used in thermal processing chambers.
Figure 2:
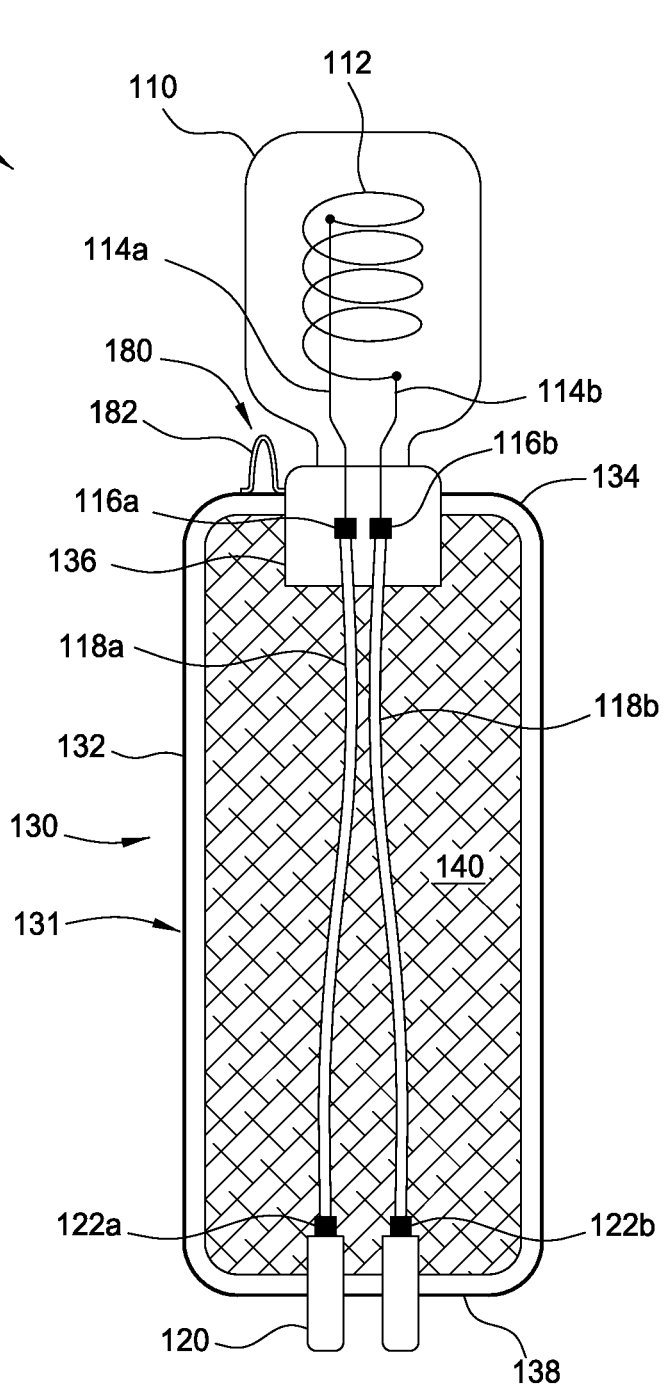
FIG. 2 is a sectional view of a lamp according to one embodiment.

FIG. 2 is a sectional view of a lamp 100 used in an RTP chamber (not shown) according to one embodiment. The lamp 100 includes a bulb 110 and a lamp base 130. The bulb 110 is connected to the lamp base 130 through a seal 136. The lamp base 130 includes a sleeve 131 surrounding a longitudinal axis (not shown), the sleeve 131 having one or more sleeve walls 132, a sealing end 134 (also referred to as a first end), and a plug end 138 (also referred to as a second end) opposite of the sealing end 134. The sealing end 134 surrounds the seal 136. A cross section of sleeve 131 could be circular, square, rectangular or any shape that sleeves typically have. The plug end 138 is coupled to a plug 120. A potting compound 140 fills the sleeve 131 including the area between the one or more sleeve walls 132 and the seal 136. The bulb 110, and sleeve 131 could be coaxial and share the same longitudinal axis that the sleeve 131 surrounds.

The bulb 110 encloses a filament 112. The filament 112 is coupled to a pair of leads 114(*a,b*). The pair of leads 114(*a,b*) are coupled to a pair of wires 118(*a,b*) through filament connectors 116(*a,b*). The wires 118(*a,b*) are coupled to plug 120 through plug connectors 122 (*a,b*). Plug 120 is coupled to electrical power (not shown) to power the lamp 100 during use.

To ease removal of lamp 100 from a thermal processing chamber (not shown), lamp base 130 further includes a hookable feature 180. Hookable feature 180 is an addition or modification to lamp base 130, allowing the lamp 100 to be removed from the chamber through the use of a hook (not shown). Hookable feature 180 is placed between about 1 mm and 20 mm from sealing end 134, for example 10 mm. In some embodiments, hookable feature 180 could be located within 5 mm of sealing end 134 or within 2 mm of sealing end 134. Hookable feature 180 is displayed as a loop 182 extending from the sealing end 134 of sleeve 131 in FIG. 2, but the hookable feature 180 can take a variety of forms. The following paragraphs provide some examples of the variety of forms that hookable feature 180 can take.

FIGS. 3A-3D are partial perspective views of lamp devices according to different embodiments.

Figure 3A:
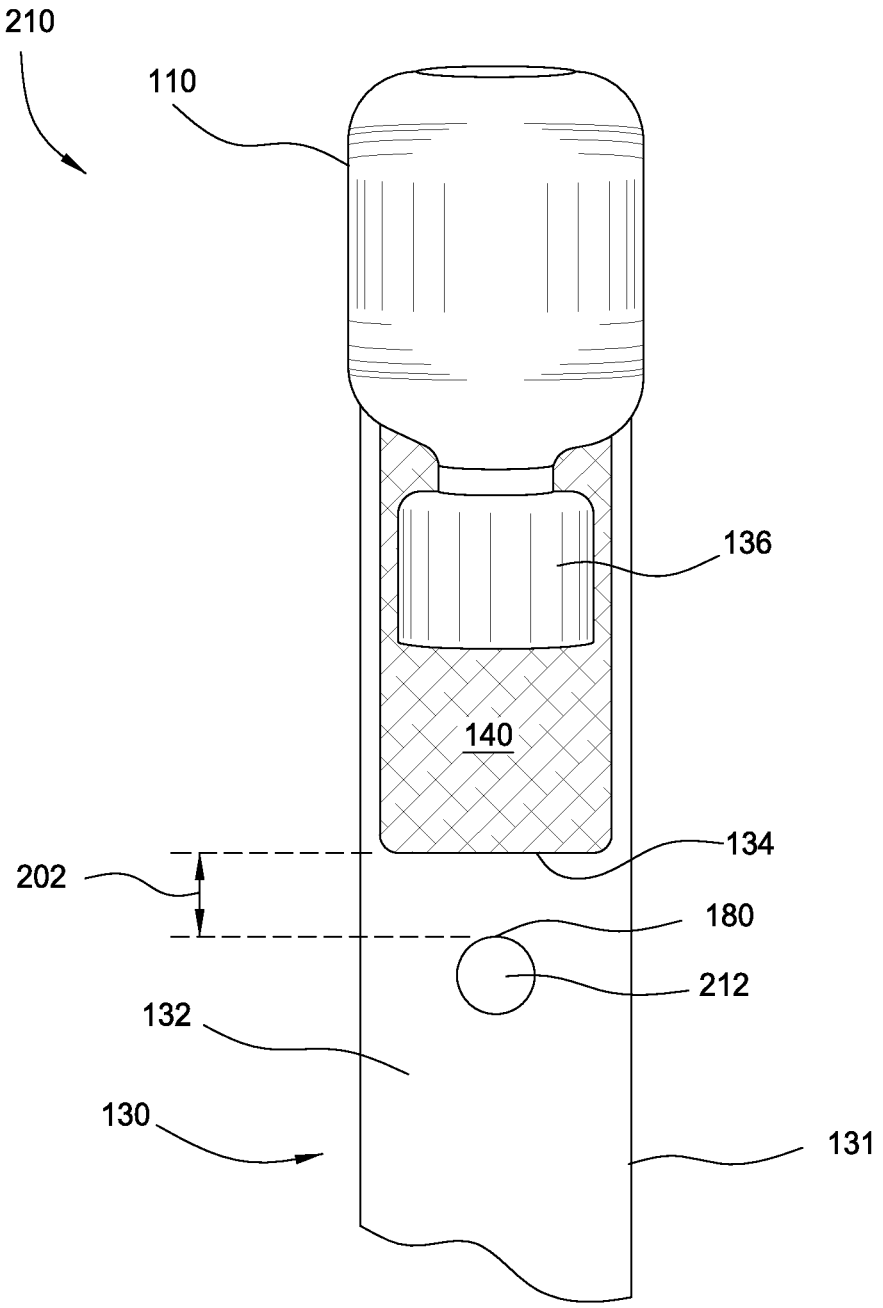
FIGS. 3A-3D are partial perspective views illustrating lamps according to different embodiments.

FIG. 3A is a partial perspective view of a lamp 210. Lamp 210 is similar to lamp 100 except the lamp 210 has one or more holes 212 through sleeve wall 132 as the hookable feature 180 instead of a loop 182. The distance 202 between the hookable feature 180, (the top of the hole 212 in this embodiment) and the sealing end 134 could be between 1 mm and 20 mm, for example 10 mm. A hook (not shown) could be inserted into hole 212 from the outside of sleeve 131. Alternatively, a hook could used to remove some potting compound 140 and the hook could be inserted through hole 212 from the inside of sleeve 131.

Figure 3B:
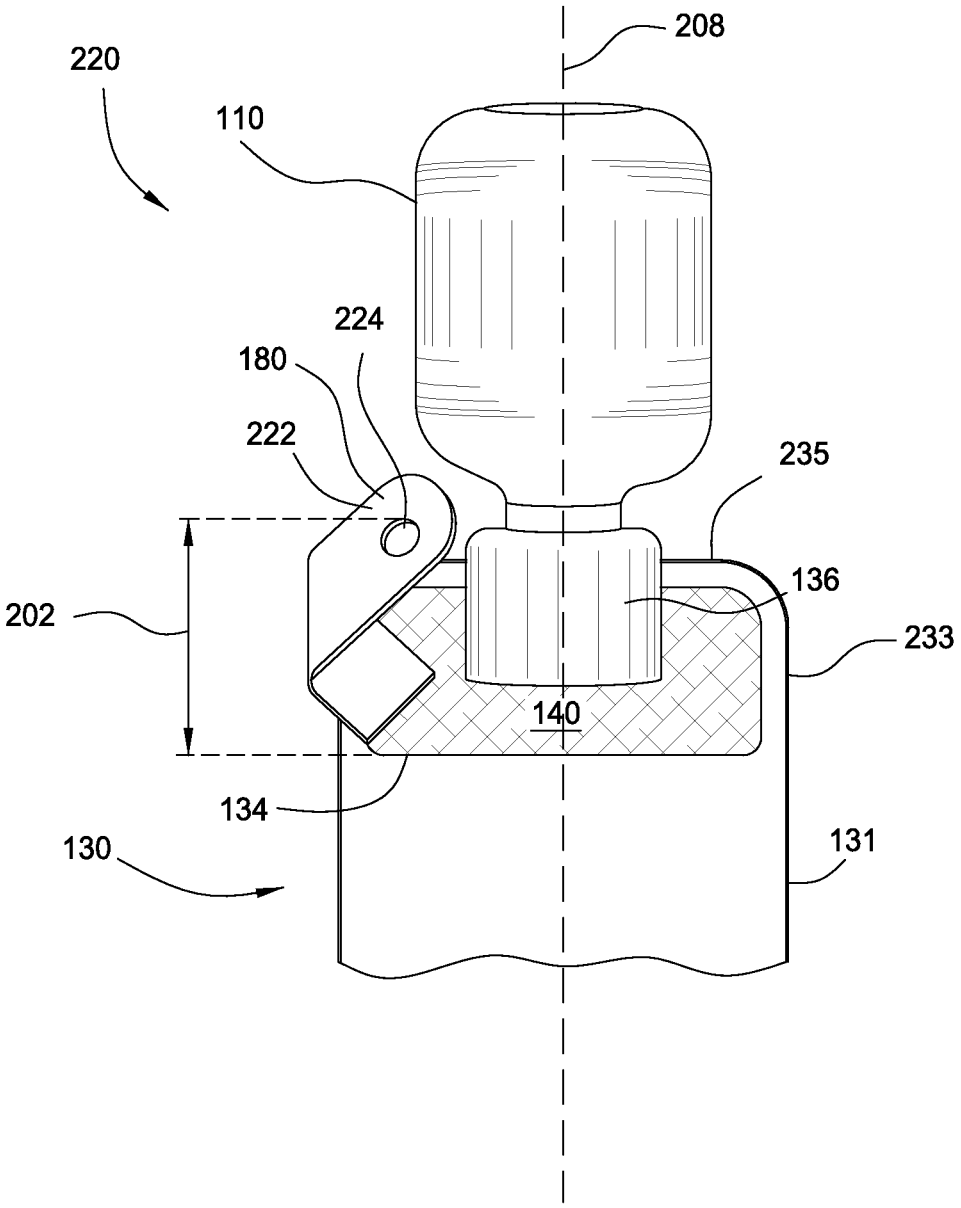

FIG. 3B is a partial perspective view of a lamp 220. Lamp 220 is similar to lamp 100 except the lamp 220 has a tab 222 with a hole 224 extending from the sealing end 134 of sleeve 131 as the hookable feature 180 instead of a loop 182. Lamp 220 could have more than one tab and tab 222 could have more than one hole. The bulb 110, the seal 136, and the lamp base 130 could all be disposed along a longitudinal axis 208. The tab 222 could be angled towards longitudinal axis 208 as displayed in FIG. 3B. Alternatively, tab 222 could be parallel to or angled away from longitudinal axis 208. Sleeve 131 could be a four-sided figure having two short sides 233 and two long sides 235, wherein all four sides 233, 235 surround the longitudinal axis 208. The hookable feature 180 could be attached to or distributed through one of the short sides 233 or one of the long sides 235. For example, tab 222 is displayed extending from the sealing end 134 of one of the short sides 233. The distance 202 between the hookable feature 180, (the top of the hole 224 in this embodiment) and the sealing end 134 could be between 1 mm and 20 mm, for example 10 mm.

Figure 3C:
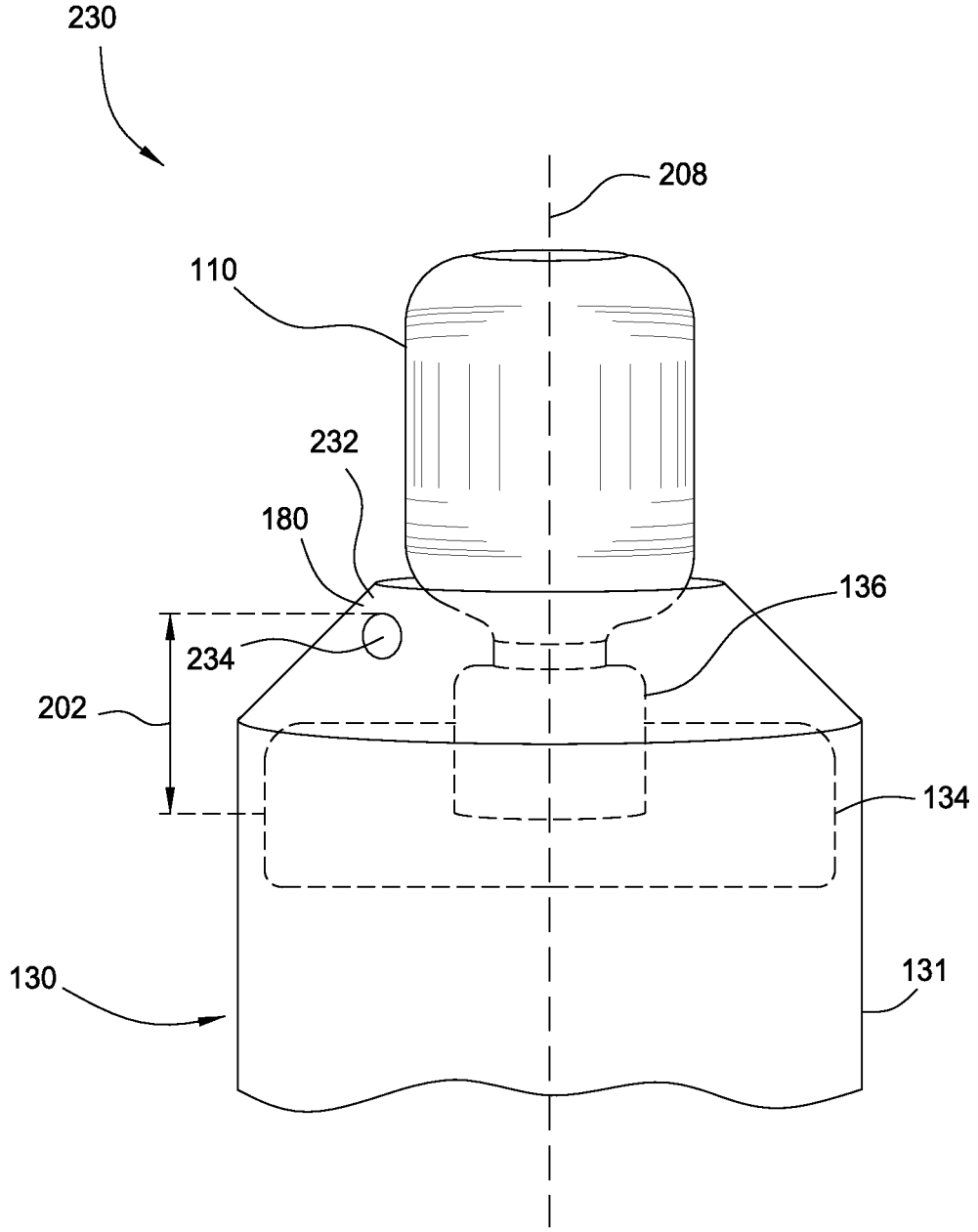

FIG. 3C is a partial perspective view of a lamp 230. Lamp 230 is similar to lamp 100 except the lamp 230 has a collar 232 with a hole 234 extending from the sealing end 134 of sleeve 131 as the hookable feature 180 instead of a loop 182. Lamp 220 could have more than one collar and collar 232 could have more than one hole. The bulb 110, the seal 136, and the lamp base 130 could all be disposed along a longitudinal axis 208. The collar 232 could be angled towards longitudinal axis 208 as displayed in FIG. 3C. Alternatively, collar 232 could be parallel to or angled away from longitudinal axis 208. The distance 202 between the hookable feature 180, (the top of the hole 234 in this embodiment) and the sealing end 134 could be between 1 mm and 20 mm, for example 10 mm.

Figure 3D:
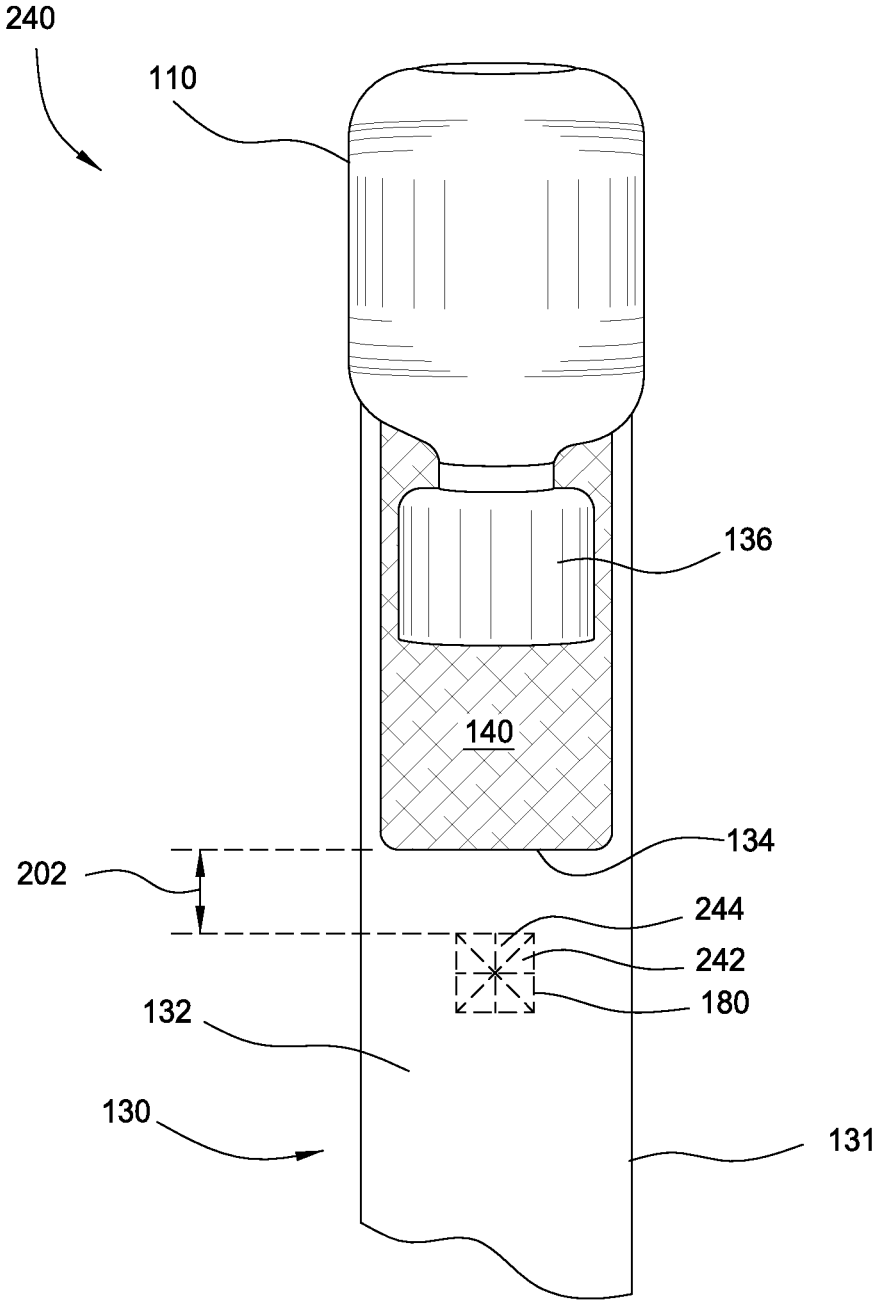

FIG. 3D is a partial perspective view of a lamp 240. Lamp 240 is similar to lamp 100 except the lamp 240 has a weakened region 242 on a sleeve wall 132 as the hookable feature 180 instead of a loop 182. The weakened region 242 could comprise a plurality of perforations 244 or scored lines (not shown) in sleeve wall 132 that could make sleeve 131 easy to puncture by a hook (not shown). Weakened region 242 could also comprise a recess or dimple (not shown) in sleeve wall 132 that could be easily punctured by a hook. Alternatively a recess or dimple that is not weakened, but is configured to be hooked could be used. Such a non-weakened recess or dimple could have a lip, rim or other feature that enables a hook to catch. The distance 202 between the hookable feature 180, (the top of weakened region 242 in this embodiment) and the sealing end 134 could be between 1 mm and 20 mm, for example 10 mm.

Referring to FIGS. 2 and 3A, lamp 100 could include more than one hookable feature 180. If there is more than one hookable feature 180, then the hookable feature could be of the same kind or of different kinds. For example, lamp 100 could include more than one loop 182 or lamp 100 could include a loop 182 and a hole 212. Different hookable features could provide different advantages to ease removal of the same lamp 100 in different equipment or different situations.

While the foregoing is directed to typical embodiments, other and further embodiments may be devised without departing from the basic scope thereof, and the scope thereof is determined by the claims that follow.

What is claimed is:

1. A lamp device for thermal processing of a substrate comprising:

a bulb enclosing a filament coupled to a pair of leads; and a lamp base comprising:

a seal connecting the bulb to the lamp base, wherein the bulb extends away from the lamp base in a first direction;

a sleeve having one or more walls and two ends, wherein one of the two ends is a sealing end that surrounds the seal;

one or more wires distributed through the sleeve and coupled to the pair of leads; and one or more hookable features, electrically isolated from the pair of leads, located within 10 mm of the sealing end to enable use of a hook to disconnect and remove the lamp device from an electrically connected position by pulling the hook in substantially the first direction when the hook is engaged with one of the hookable features.

2. The device of claim 1, wherein the one or more hookable features comprises one or more holes through at least one wall of the sleeve.

3. The device of claim 1, wherein the one or more hookable features comprises one or more tabs extending from the sealing end, the one or more tabs each having one or more holes.

4. The device of claim 1, wherein the one or more hookable features comprises a collar extending from the sealing end, the collar having one or more holes.

5. The device of claim 1, wherein the one or more hookable features comprises one or more loops extending from the sealing end.

6. The device of claim 1, wherein the one or more hookable features comprises one or more weakened regions on at least one sleeve wall.

7. The device of claim 6, wherein the one or more weakened regions comprises a plurality of perforations.

8. The device of claim 1, wherein the one or more hookable features are located within 5 mm of the sealing end.

9. The lamp device of claim 1, wherein the one or more hookable features are located within 2 mm of the sealing end.

10. A lamp device for thermal processing of a substrate comprising:

a bulb enclosing a filament coupled to a pair of leads; and a lamp base comprising:

a seal connecting the bulb to the lamp base, wherein the bulb extends away from the lamp base in a first direction;

a sleeve extending around a longitudinal axis and having a first end and a second end, the first end being opposite of the second end, wherein the first end surrounds the seal; and one or more hookable features, electrically isolated from the pair of leads, located within 10 mm of the first end to enable use of a hook to disconnect and remove the lamp device from an electrically connected position by pulling the hook in substantially the first direction when the hook is engaged with one of the hookable features.

11. The device of claim 10, wherein the sleeve comprises a four-sided figure having two short sides and two long sides, wherein all four sides surround the longitudinal axis.

12. The device of claim 11, wherein the one or more hookable features comprises one or more holes through at least one of the short sides.

13. The device of claim 11, wherein the one or more hookable features comprises one or more tabs having one or more holes and extending from at least one of the short sides, wherein the one or more tabs are angled towards the longitudinal axis.

14. The device of claim 11, wherein the one or more hookable features comprises a collar having one or more holes and extending from the first end, wherein the collar is angled towards the longitudinal axis.

15. The device of claim 11, wherein the one or more hookable features comprises one or more loops extending from at least one of the short sides.

16. The device of claim 11, wherein the one or more hookable features comprises one or more weakened regions on at least one of the short sides.

17. The device of claim 11 further comprising one or more conductors distributed through the sleeve and coupled to the pair of leads at the first end and coupled to a plug located at the second end.

18. The device of claim 11, wherein the one or more hookable features are located within 5 mm of the first end.

19. The lamp device of claim 11, wherein the one or more hookable features are located within 2 mm of the first end.

20. A lamp device for thermal processing of a substrate comprising:

a bulb enclosing a filament coupled to a pair of leads; and a lamp base comprising:

a seal connecting the bulb to the lamp base, wherein the bulb extends away from the lamp base in a first direction;

a sleeve extending around a longitudinal axis and having a first end and a second end, the first end being opposite of the second end, wherein the first end surrounds the seal;

a potting compound filling the sleeve; and one or more tabs having one or more holes, the one or more holes located within 10 mm of the first end, wherein the one or more tabs extend from the first end and are angled towards the longitudinal axis to enable use of a hook, electrically isolated from the pair of leads, to disconnect and remove the lamp device from an electrically connected position by pulling the hook in substantially the first direction when the hook is engaged with one of the holes of the one or more tabs.

* * * * *